US011208757B2

(12) United States Patent
Bringewatt et al.

(10) Patent No.: US 11,208,757 B2
(45) Date of Patent: Dec. 28, 2021

(54) METHOD AND APPARATUS FOR IRONING AND FOLDING LAUNDRY ITEMS

(71) Applicant: Herbert Kannegiesser GmbH, Vlotho (DE)

(72) Inventors: Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 65 days.

(21) Appl. No.: 16/750,125

(22) Filed: Jan. 23, 2020

(65) Prior Publication Data

US 2020/0240072 A1 Jul. 30, 2020

(30) Foreign Application Priority Data

Jan. 24, 2019 (DE) ..... 102019000467.1

(51) Int. Cl.

| | |
|---|---|
| ***D06F 69/02*** | (2006.01) |
| ***D06F 67/10*** | (2006.01) |
| ***D06F 89/02*** | (2006.01) |
| *D06F 67/02* | (2006.01) |
| *D06F 67/04* | (2006.01) |

(52) U.S. Cl.

CPC ..... *D06F 69/02* (2013.01); *D06F 67/10* (2013.01); *D06F 89/02* (2013.01); *D06F 67/04* (2013.01)

(58) Field of Classification Search

CPC ..... D06F 69/02; D06F 67/04; D06F 67/10; D06F 67/89; D06F 67/00; D06F 67/02

See application file for complete search history.

(56) References Cited

U.S. PATENT DOCUMENTS 1,519,733 A * 12/1924 Kohn ..... B65H 45/18 493/17
2,291,487 A * 7/1942 Myers ..... D06F 89/00 493/8
2,924,451 A * 2/1960 Benjamin ..... D06F 89/00 493/21

(Continued)

FOREIGN PATENT DOCUMENTS

DE 9301400 U1 5/1993
DE 102017000620 A1 7/2018

(Continued)

OTHER PUBLICATIONS

European Patent Office, Europaischer Recherchenbericht (searchin a related application), dated May 15, 2020.

(Continued)

*Primary Examiner* — Ismael Izaguirre

(74) *Attorney, Agent, or Firm* — Laurence P. Colton; Smith Tempel Blaha LLC

(57) ABSTRACT

A method and apparatus that makes provision for two identical folding machines to be arranged one beside the other, and for these to be operated synchronously, so that the large operating width which is necessary for ironing large laundry items, in particular transversely, is also available for folding such laundry items. If large laundry items are to be ironed, and folded, in particular transversely, this requires ironers and folding machines with an appropriately large operating width. Such large operating widths currently cannot be realized technologically in folding machines.

19 Claims, 4 Drawing Sheets

(56) References Cited

U.S. PATENT DOCUMENTS

| | | | | | |
|---|---|---|---|---|---|
| 2,974,948 | A | | 3/1961 | Malott | |
| 3,437,334 | A | * | 4/1969 | Maldonado | D06F 89/00 493/14 |
| 4,327,510 | A | * | 5/1982 | Grantham | D06F 67/04 223/37 |
| 5,540,647 | A | * | 7/1996 | Weiermann | D06F 89/00 493/444 |

FOREIGN PATENT DOCUMENTS

| | | | | |
|---|---|---|---|---|
| EP | 0172753 | A2 | | 2/1986 |
| GB | 715271 | A | * | 9/1954 |

OTHER PUBLICATIONS

Deutsches Patent—Und Markenamt (German Patent and Trademark Office), Recherchenbericht (search in a related application), dated Sep. 27, 2019.

* cited by examiner

METHOD AND APPARATUS FOR IRONING AND FOLDING LAUNDRY ITEMS

CROSS REFERENCE TO RELATED APPLICATIONS

This patent application claims priority on and the benefit of German Patent Application No. 10 2019 000 467.1 having a filing date of 24 Jan. 2019.

BACKGROUND OF THE INVENTION

Technical Field

The invention relates to a method for ironing and folding laundry items wherein at least one ironer irons the laundry items running through it in an ironing direction, the ironed laundry items are transported in the ironing direction to at least one folding machine, which follows the ironer or the at least one final ironer, and they are folded in the at least one folding machine. The invention also relates to an apparatus for ironing and folding laundry items using at least one ironer, having an entry region and an exit region, which follows the entry region in the ironing direction, and also at least one folding machine, which follows the exit region of the at least one ironer in the ironing direction.

Prior Art

In particular in commercial laundries, laundry items are folded mechanically after having been ironed. Particularly large and/or relatively wide or long flatwork-linen items such as (king-size) bed sheets and tablecloths require ironers and folding machines with appropriately large operating widths. Added to this is the fact that it is desirable for such large or fairly long or wide laundry items to be ironed, if possible, in a transversely directed manner, so that it is easier for such large-surface-area laundry items to be supplied to the ironer, and in particular even large laundry items can be spread out to a sufficient extent in order to be supplied to the ironer.

In order for it to be possible for large laundry items, in particular king-size flatwork-linen items to be ironed, and folded, in a transversely directed manner, that is to say with the relatively large dimension running transversely to the supply and ironing direction (referred to hereinbelow as "length"), operating widths of at least 5 m are necessary. While such operating widths can be realized in ironers, the same is not the case for folding machines. The latter have belt conveyors with circulating folding belts of which the operating width has to extend, at least in the region of a first folding station, over the entire operating width of the ironer. The endless folding belts are deflected on narrow rollers with comparatively small diameters. Since said deflecting rollers must not bend, the operating widths of folding machines, for stability-related reasons, are limited. It is therefore not possible for large laundry items to be ironed in a transversely directed manner, even though the ironers could be constructed to have an appropriately large operating width.

BRIEF SUMMARY OF THE INVENTION

The object of the invention, then, is to create a method and an apparatus which make it possible for large laundry items to be both ironed and folded in a transversely directed manner.

A method for achieving this object is a method for ironing and folding laundry items, wherein at least one ironer irons the laundry items running through it in an ironing direction, the ironed laundry items are transported in the ironing direction to at least one folding machine, which follows the ironer or the at least one final ironer, and they are folded in the at least one folding machine, wherein the ironed laundry items are folded simultaneously or optionally simultaneously or also independently of one another by a plurality of adjacent folding machines. Accordingly, the ironed laundry items are folded simultaneously or optionally simultaneously or also independently of one another by a plurality of, preferably two, folding machines grouped one beside the other in a twin layout. The simultaneous folding of a respective laundry item takes place continuously on the adjacent folding machines. The folding machines together fold the respective laundry item simultaneously and synchronously. The adjacent folding machines here form at least one continuous, multi-lane folding surface, which is located in a single plane, in order to fold a large laundry item together and simultaneously, or to fold a respective laundry item. As a result, the arrangement of a plurality of folding machines one beside the other, on account of the latter participating together in folding a large laundry item, gives rise to an operating width which corresponds to the sum of the operating widths of each of the adjacent folding machines. The simultaneous folding of the respective laundry item on the plurality of adjacent folding machines thus makes it possible for laundry items which take up the entire operating width of the at least one ironer to be folded, once they have been ironed, in that the arrangement of a plurality of folding machines one beside the other results pretty much in an operating width which corresponds to that of the at least one ironer.

The adjacent folding machines are preferably connected to one another and/or coupled together, this giving rise to a multi-lane folding machine with the operating width of the single ironer or of a plurality of successive ironers.

The method can be developed such that the laundry items are folded by adjacent folding machines optionally together, preferably at the same time, simultaneously, in the same way and/or concurrently, or, in the case of folding machines which operate independently of one another, possibly with a time delay. It is thus possible for optionally relatively large or relatively small laundry items to be ironed, and to be folded, in that laundry items which take up at least more or less the operating width of the ironer, or of the respective ironer, can also be folded by the adjacent, coupled folding machines with an operating width corresponding to the at least one ironer. If, in the case of relatively small laundry items, the respective ironer is operated over a plurality of lanes, it is also possible for the folding machine to be operated over a plurality of lanes, in that the adjacent folding machines, although coupled together physically, are operated independently and/or individually.

It is preferably the case with large laundry items which are ironed in one lane, and take up more than half the operating width of the at least one ironer, that said large laundry items which are ironed in one lane are folded in the same way in one lane by the identical, concurrently and synchronously operated folding machines arranged one beside the other. In contrast, relatively small laundry items which are ironed over a plurality of lanes, and take up less than half the operating width of the at least one ironer, can be folded over a plurality of lanes by the identical folding machines arranged one beside the other, in which case the folding machines are operated independently of one another, that is to say in this case they are driven not synchronously, but independently of one another, and therefore possibly each of the adjacent folding machines can fold laundry items on different lanes of the ironer, or of the respective ironer, at different times, that is to say precisely when an ironed laundry item leaves a lane of the relevant ironer.

An apparatus for achieving the object mentioned in the introduction is an apparatus for ironing and folding laundry items using at least one ironer, having an entry region and an exit region, which follows the entry region in the ironing direction, and also at least one folding machine, which follows the exit region of the at least one ironer in the ironing direction, wherein the at least one ironer is followed by adjacent folding machines. Accordingly, the at least one ironer is followed by a plurality of adjacent folding machines. The adjacent folding machines can also fold large ironed laundry items which take up at least the entire operating width of the at least one ironer. Arranging a plurality of folding machines one beside the other makes it possible for the rollers for deflecting and/or driving the folding belts to be shorter. This means that the stability of the folding machines is not adversely affected as a result of the operating width thereof being increased.

Provision is preferably made for the adjacent folding machines to be coupled together, preferably on their mutually facing sides. The adjacent folding machines therefore form a unit, to be precise pretty much a rigid unit. This means that the operating width can extend functionally and continuously over the adjacent folding machines, which are coupled together and/or connected to one another for this purpose.

Provision is also preferably made for mutually facing sides of deflecting and/or driving drums of folding belts of the adjacent folding machines to be mounted together, by way of for example at least one bearing frame, on bearing means, preferably at least for the most part fixed-location bearing means, which are arranged between the folding machines, or respectively adjacent folding machines. This results, between the adjacent folding machines, in additional inner supports for the deflecting and/or driving drums of the folding belts, said inner supports stabilizing the deflecting and/or driving drums and allowing folding of the ironed laundry items over a folding or operating width which corresponds to the operating width of the at least one ironer. Moreover, the adjacent folding machines are mechanically coupled together in this way.

According to another advantageous development of the apparatus, outer sides of two adjacent folding machines are assigned drives for the at least one folding belt. In the case of two adjacent folding machines, each outer side of a folding machine is freely accessible and provides space for at least one drive on each side. These drives can be designed, in principle, in exactly the same way as is customary for the individual folding machines.

An apparatus of preferred design has identical folding machines arranged one beside the other. In particular, these folding machines have identical operating widths. Identical folding machines arranged one beside the other can be used to form, in practice, a tandem folding machine, which is of identical design throughout over the operating widths of the adjacent folding machines and performs identical folding arrangements and folding operations. That part of the laundry item for folding which is located on the one folding machine is therefore folded in exactly the same way as that part of the laundry item which is located on the other folding machine. It is therefore the case that those parts of the respective laundry item which are located on the adjacent folding machines can be folded simultaneously, concurrently and in the same way. The plurality of adjacent folding machines then fold the laundry item in exactly the same way as a folding machine with an operating width equal to the sum of the operating widths of the individual folding machines arranged one beside the other.

Provision is also made, according to an advantageous possible configuration of the apparatus, for the sum of the operating widths of all the adjacent folding machines to correspond at least to the operating width of the individual ironer, or of the plurality of ironers arranged one behind the other. It is thus possible for large laundry items which extend over more than half the operating width of the ironer or of the ironers to be folded by the adjacent folding machines, which follow the single or final ironer, with an identical, or essentially identical, operating width.

The apparatus is advantageously designed such that at least those strands of the folding belts of the adjacent folding machines which come into contact with the laundry items are located in a common plane. The width of this at least one plane provides the overall operating width of the adjacent folding machines, which corresponds preferably to the operating width of the at least one ironer or can possibly also be somewhat greater or smaller. This allows ironed laundry items, immediately after they have been ironed, also to be folded over the same operating width.

An advantageous possible development of the apparatus provides for each of the adjacent folding machines to have at least one dedicated drive, wherein the drives can be driven synchronously in the same way if the folding width is to correspond to the operating width of the at least one ironer, that is to say if large laundry items are to be folded, to be precise possibly also transversely. However, provision can be made for it to be possible to choose between synchronous and independent operation of the drives of the adjacent folding machines. It is recommended for optionally large laundry items to be ironed, and folded, in one lane or for relatively small laundry items to be ironed, and folded, over a plurality of lanes. Individual operation of the adjacent folding machines then means that relatively small laundry items, once they have been ironed over a plurality of lanes, can also be folded over a plurality of lanes since, as a result of a separate drive in the adjacent folding machines, each lane of the at least one ironer is followed by a folding machine of which the drive is coordinated with the ironer arranged upstream of it. This provides for flexible and universal use of the apparatus for ironing both large and small laundry items, and also provides for the laundry items to be ironed, and folded, longitudinally and/or in a transversely directed manner.

BRIEF DESCRIPTION OF THE DRAWINGS

A preferred exemplary embodiment of the invention will be explained in more detail hereinbelow, with reference to the drawing, in which.

DETAILED DESCRIPTION OF PREFERRED EMBODIMENTS

Figure 1:
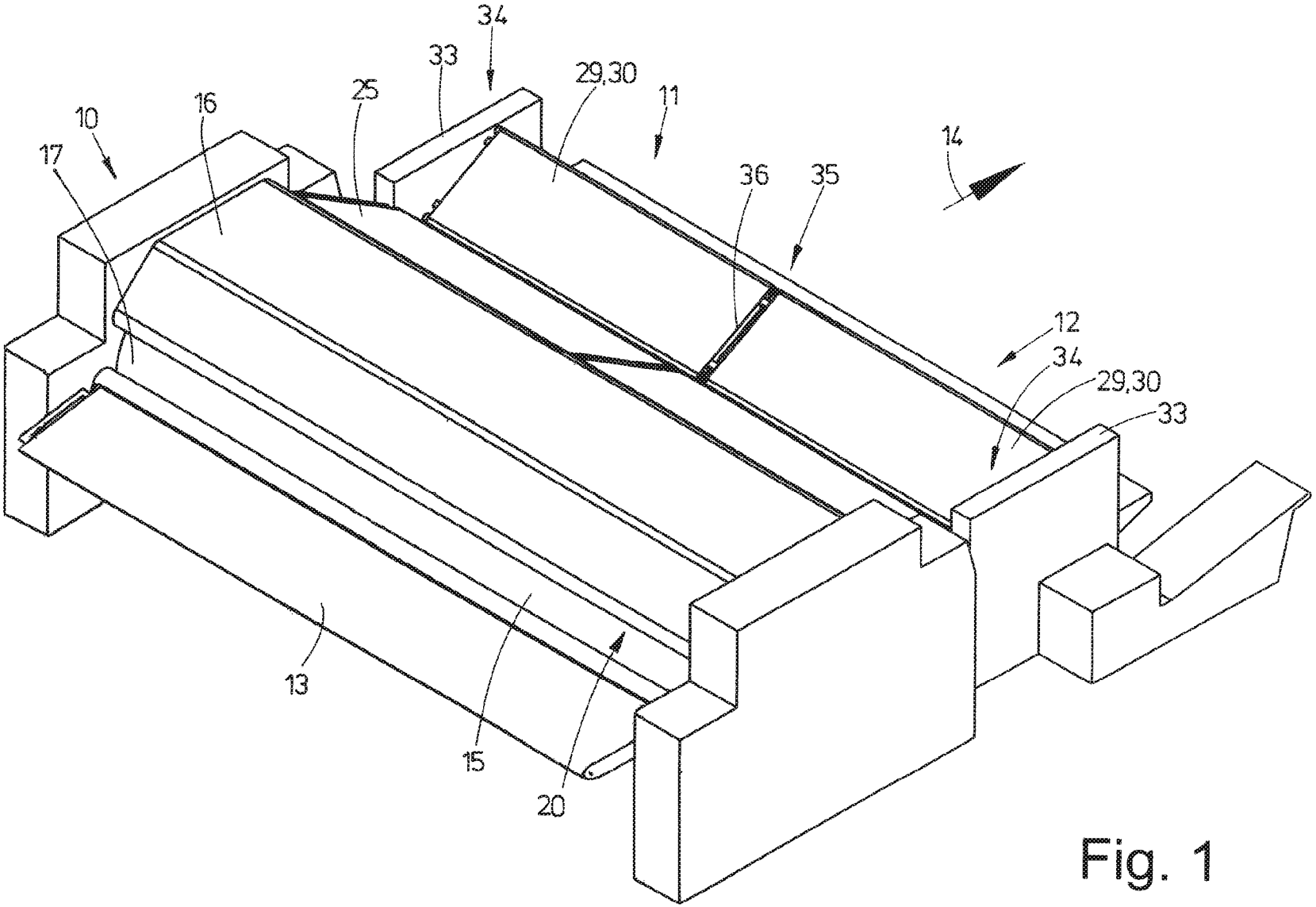
FIG. 1 shows a perspective illustration of an exemplary embodiment of the apparatus.
Figure 2:
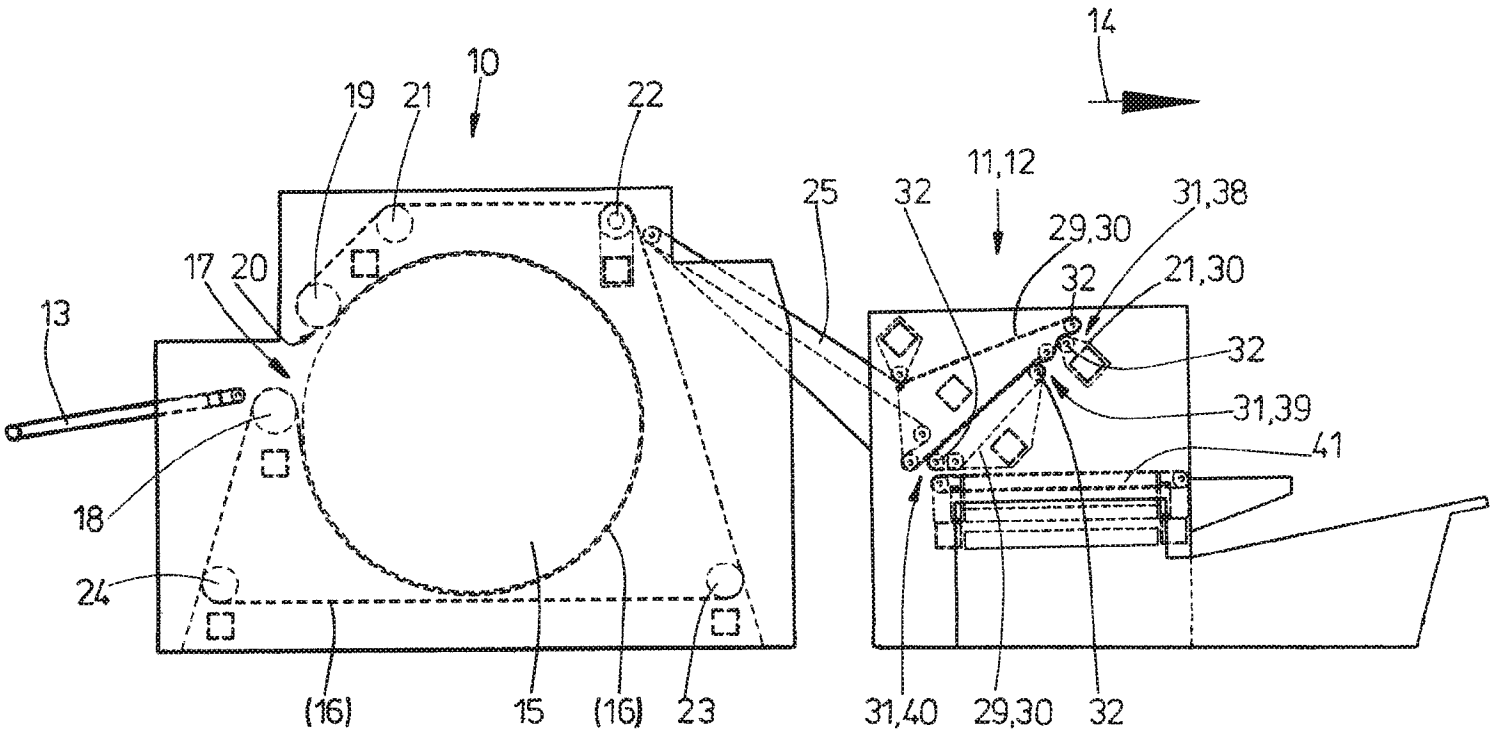
FIG. 2 shows a side view of the apparatus from FIG. 1.

The apparatus shown has an ironer 10 and two adjacent folding machines 11 and 12 following the same. The ironer 10 can have provided upstream of it a feeding machine (not shown in the figures), which spreads out the laundry items and supplies them, in the spread-out state, to the ironer 10 via a supply conveyor 13.

In the exemplary embodiment shown, the ironer 10 is a so-called belt ironer. However, the apparatus can also have ironers of other types, for example chest-heated ironers. The figures illustrate a single ironer 10 upstream of the folding machines 11, 12. It is also possible, however, for the apparatus to have a plurality of successive ironers 10. These can be identical ironers, for example belt ironers, or different ironers, for example a belt ironer or a chest-heated ironer. It is also possible for the apparatus to have a plurality of successive chest-heated ironers or a chest-heated ironer with a plurality of ironer rolls arranged one behind the other and ironer chests assigned to said rolls.

The laundry items (not shown in the figures) are preferably flatwork-linen items such as tablecloths, bed sheets, bed covers or the like.

The apparatus according to the invention is designed to iron, and to fold, only, or in addition, very large laundry items, so-called king-size flatwork linen, in particular large tablecloths and king-size bed sheets and/or bed covers. In particular, the apparatus according to the invention is provided also to iron, and to fold, large laundry items transversely. In this case, the large, transversely directed laundry items pass, with their long edges running transversely to the ironing direction 14, through both the ironer 10, or also a plurality of ironers 10 following one after the other in the ironing direction 14, and also adjacent folding machines 11 and 12, which at the same time follow the ironer 10, or the final ironer 10, in the ironing direction 14, in order to be folded by said folding machines together.

The ironer 10 has an operating width which allows large laundry items, in particular king-size flatwork linen, to be ironed with the long edges directed transversely. Such an ironer 10 can have an operating width of 5 m or above. The laundry items are folded over an identical operating width, for which purpose the two folding machines 11 and 12 are arranged one beside the other in tandem, or to form a double lane, so as to have, together, an operating width which corresponds to the operating width of the ironer 10 or ironers 10.

The ironer 10, which in the exemplary embodiment shown is designed in the form of a belt ironer, has a heatable, preferably cylindrical, ironer body 15, which can be at a standstill, but can also be driven to rotate about a horizontal longitudinal center axis. The ironer body 15, which in the present case is cylindrical, is enclosed on the outside, for the most part, by part of an endless ironer belt 16, which is continuous over the entire operating width of the ironer 10.

In the entry region 17 of the ironer 10, the ironer belt 16 is guided onto the heatable ironer body 15 from the outside around a deflecting drum 18. From the entry region 17, the ironer belt 16 extends, with abutment against the outside of the lateral surface of the ironer body 15, as far as a deflecting drum 19 in the exit region 20 of the ironer 10, where the ironer belt 16 is directed away from the ironer body 15 again. As a result of the exit region 20 being arranged at a small distance above the entry region 17, part of the ironer belt 16 wraps around the outer, heated lateral surface of the ironer body 15 over a major part of the circumference. The angle of wrap can be 270° to 340°. The ironer belt 16, which is directed away from the ironer body 15 by the deflecting drum 19 in the exit region 20, is guided back around the outside of the ironer body 15, via deflecting drums 21 to 24, to the deflecting drum 18 in the entry region 17. At least one of the deflecting drums 18, 19, 21, 22, 23 and/or 24 is provided with a drive. It is also conceivable for at least one of the deflecting drums 21, 22, 23, 24 to be of transversely displaceable design for the purpose of tensioning the ironer belt 16.

The ironer belt 16 is driven such that the respective laundry item slides along the outer side of the heated wall of the ironer body 15 as it is carried along by the ironer belt from the entry region 17 to the exit region 20. The respective laundry item here is ironed, to be precise smoothed out and, for the most part, dried.

The laundry item, which is spread out for example by the feeding machine (not shown), is supplied to the entry region 17 of the ironer 10 by the supply conveyor 13. The ironed laundry item leaving the exit region 20 of the ironer 10 is transferred over the ironer body 15 in the ironing direction 14, via that portion of the ironer belt 16 which is guided back over the ironer body 15, to a removal conveyor 25, which adjoins the deflecting drum 22 and follows the latter in the ironing direction 14. From the removal conveyor 25, the ironed laundry item is supplied, in the ironing direction 14, to the folding machines 11 and 12. The removal conveyor 25 here serves, simultaneously, as a supply conveyor for supplying ironed laundry items to the folding machines 11 and 12.

Figure 3:
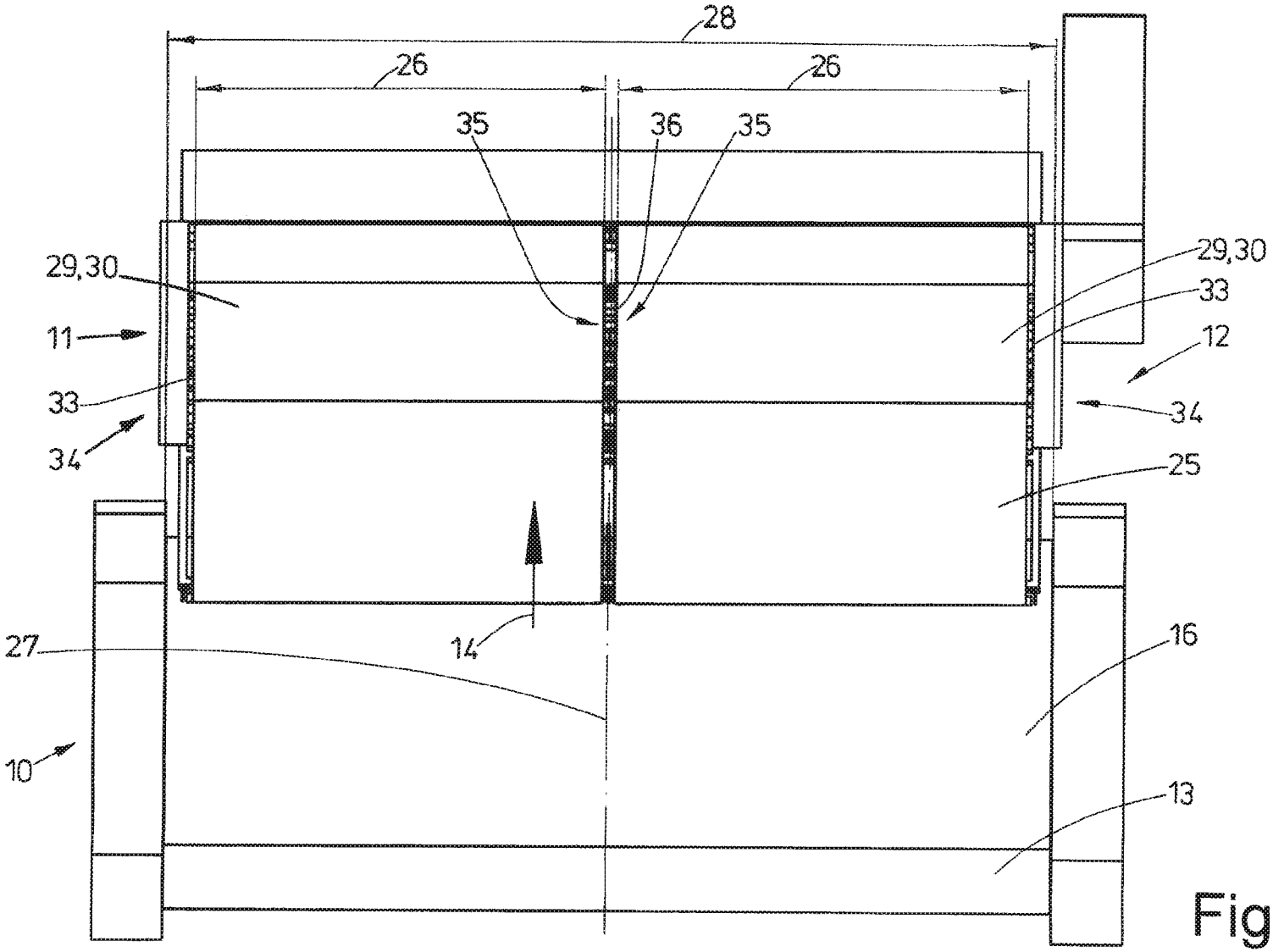
FIG. 3 shows a plan view of the apparatus from FIGS. 1 and 2.

The two folding machines 11, 12, which follow the ironer 10 in the ironing direction 14, are of identical design. In particular, the two folding machines 11 and 12 have an identical operating width 26. However, the two folding machines 11 and 12 are arranged in mirror-inverted fashion one beside the other, to be precise as seen in relation to a longitudinal center axis 27 of the ironer 10, said axis running in the ironing direction 14. Said longitudinal center axis 27 runs centrally through the operating width 28 of the ironer 10. As seen in relation to said longitudinal center axis 27, the two identical folding machines 11 and 12 are arranged in mirror-inverted fashion relative to one another on opposite sides of the longitudinal center axis 27 (FIG. 3). In the exemplary embodiment shown, the therefore identical operating widths 26 of the two folding machines 11 and 12 are more or less equal to the operating width 28 of the ironer 10. It is also conceivable to select the sum of the operating widths 26 of the two folding machines 11 and 12 such that they are identical to the operating width 28 of the ironer 10 or somewhat greater.

Each of the identical folding machines 11 and 12 have a plurality of folding mechanisms, which are designed preferably in the form of circulating belt conveyors. An endless conveyor belt of the respective belt conveyor 29 can therefore be referred to as folding belt 30. In order to perform a folding operation, two belt conveyors 29 are arranged relative to one another such that a folding gap 31 forms between them. Reversal of at least one belt conveyor 29 causes part of the laundry item which is to be folded first of all to be moved up onto the folding belt 30 of said belt conveyor 29, and therefore subsequent reversal of the direction of rotation of the reversible belt conveyor 29 causes the laundry item to be transported through the folding gap 31 in two layers, or with a doubled number of layers, and to be folded in the process, preferably folded transversely, to be precise preferably with the assistance of knife folders (not shown in the figures).

Transverse folding or longitudinal folding depends on whether the folding line around which parts of the laundry item are folded through 180° by in each case two interacting folding belts 30 runs transversely or longitudinally in relation to the direction in which the laundry items pass through the folding machines 11 and 12, said through-passage direction coinciding with the ironing direction 14. For transverse folding, the folding line runs transversely in relation to the through-passage or ironing direction 14; for longitudinal folding, it runs longitudinally in relation to the same.

The folding machines 11 and 12 are designed such that they perform at least one, preferably more than one, transverse folding operation, and preferably also at least one longitudinal folding operation, on the laundry item. At least one transverse folding operation takes place initially, as a result of which the length of the laundry item in the ironing direction 14 and in the folding direction, which coincides with the ironing direction during the transverse folding operation, is shortened, in particular halved.

In the case of folding machines 11, 12 having belt conveyors 29 which have folding belts 30, the endless folding belts 30 of each belt conveyor 29 are deflected about at least two parallel deflecting drums 32, of which one deflecting drum 32 of each belt conveyor 29 can be driven.

For space-related reasons, but also for the purpose of improving the folding quality, said deflecting drums 32, which extend over the entire width, in particular operating width 26, of the respective folding machine 11, 12 are provided with a relatively small diameter, as a result of which the deflecting drums 32 are relatively narrow. It is therefore possible for the deflecting drums 32 to have only a limited length, as a result of which it is also the case that the operating width in the folding machine 11, 12 is limited. This is why, according to the invention, two folding machines 11, 12 are arranged one beside the other, so that together they correspond to the operating width 28 of the ironer 10 (or are somewhat smaller or somewhat greater than the same).

In particular the deflecting drums 32 of the belt conveyors 29 of the folding machines 11 and 12 are mounted on a fixed-location, rack-like bearing frame 33, with outer ends on outer sides 34 of the folding machines 11, 12. Said bearing frames 33 are located in vertical planes which run parallel to the longitudinal center axis 27 of the ironer 10 and of the folding machines 11, 12. The ends of the deflecting drums 32 of the two folding machines 11 and 12 are mounted together, on mutually facing inner sides 35 of the folding machines 11 and 12, on a bearing frame 36, which runs in a vertical plane through the longitudinal center axis 27 of the ironer 10 and centrally between the outer bearing frames 33.

Figure 4:
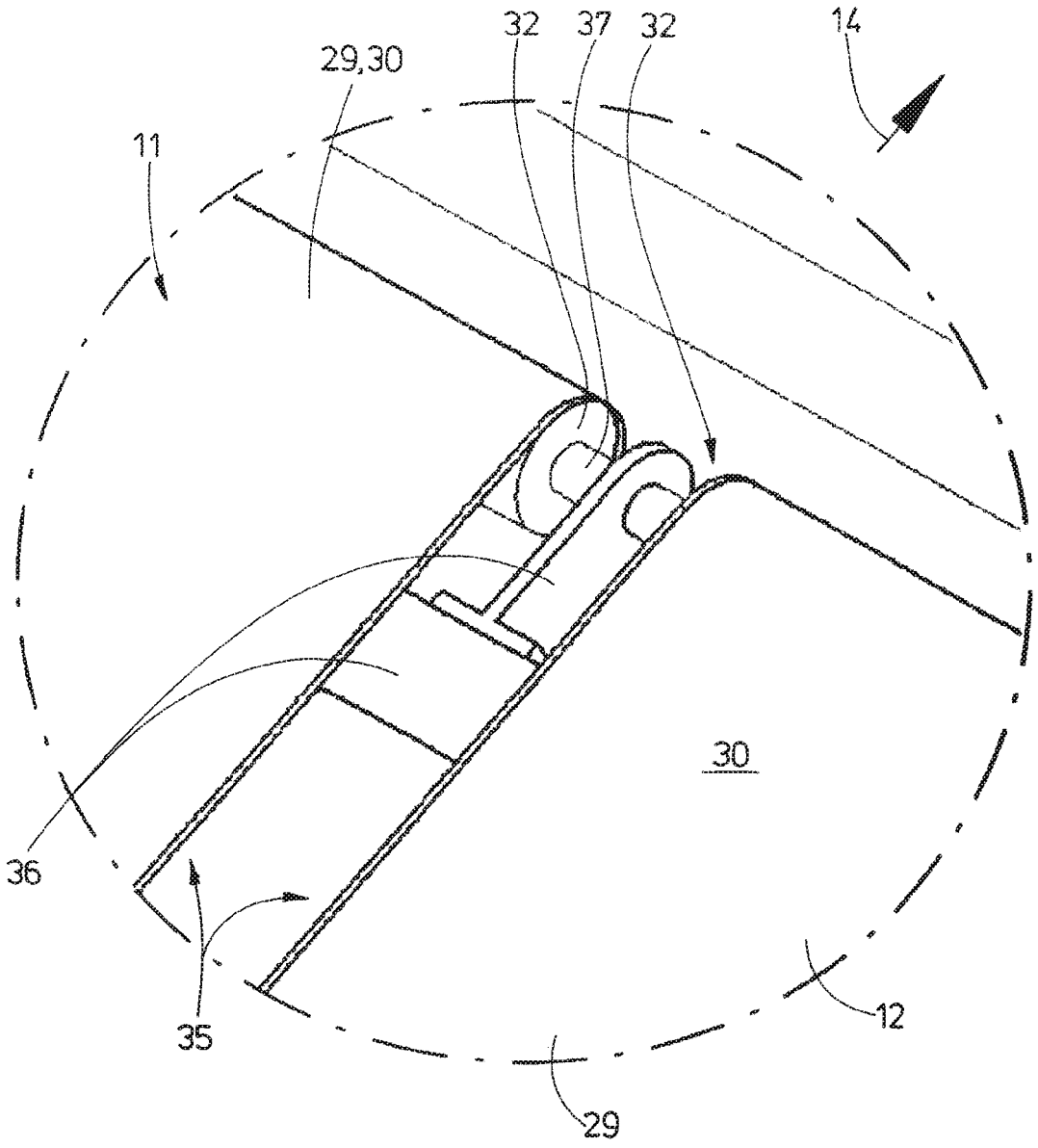
FIG. 4 shows an enlarged detail IV from FIG. 1.

The two adjacent folding machines 11, 12 are coupled together and/or connected to one another, and thus interlinked, on, or by way of, the central bearing frame 36. According to the illustration in FIG. 4, adjacent deflecting drums 32 of the adjacent folding machines 11, 12 are mounted in a rotatable manner on a preferably fixed spindle 37. This common spindle 37 extends over the entire width of the adjacent folding machines 11 and 12, that is to say over the common operating width 26 thereof. Outer ends of the spindle 37 are mounted (not illustrated) in the outer bearing frames 33 on opposite outer sides 34 of the folding machines 11 and 12, whereas, according to FIG. 4, a central region of the spindle 37, which extends continuously over the width of the two folding machines 11 and 12, is supported in the central bearing frame 36. As a result, one outer bearing frame 33 and the central bearing frame 36 form a support for half of the spindle 37, which extends over the width of one folding machine 11 or 12, whereas the other half of the spindle 37, which extends over the width of the adjacent folding machine 11 or 12, is supported between the other outer bearing frame 33 of said adjacent folding machine 11 or 12 and the central bearing frame 36.

It is conceivable to have an alternative exemplary embodiment in which the deflecting drums 32 of the adjacent folding machines 11 and 12 are fixed to a shaft which extends over the width of the respective folding machine 11, on the one hand, and 12, on the other hand, that is to say a shaft which does not run continuously over the operating width 26 of the two adjacent folding machines 11, 12, as is the case with the spindle 37. In the alternative exemplary embodiment, the ends of the relatively short shafts of the deflecting drums 32 are mounted, and supported, in preferably rolling bearings, which are flanged to the inside of the outer bearing frames 33 and on either side of the central bearing frame 36.

As described above in conjunction with the deflecting drum 32, all the deflecting drums 32 and/or each transverse-folding station 38, 39, 40 of the folding machines 11 and 12 are mounted on the bearing frames 33 and 36 and/or are supported in the bearing frames 33, 36.

The folding machines 11 and 12 shown in the figures in the same way have three transverse-folding stations 38, 39 and 40, which follow one after the other in the ironing direction 14, and at least one longitudinal-folding station 41, which follows the transverse-folding stations. First of all, the respective ironed laundry item leaving the ironer 10 is transversely folded once (with folding lines running transversely in relation to the ironing direction 14) in the transverse-folding station 38, then the transverse-folding station 39, and then the transverse-folding station 40, one after the other and, subsequently, the laundry item which has previously been transversely folded once is longitudinally folded at least once in the longitudinal-folding station 41. However, the invention is not restricted to the folding machine 11, 12 shown and described above. The invention is also suitable for folding machines 11, 12 with a smaller or greater number of transverse-folding stations 38, 39 and 40. It is also possible for the transverse-folding stations 38, 39, 40 and/or for the at least one longitudinal-folding station 41 to be designed differently to those described above and shown in the figures.

The method according to the invention will be explained in more detail hereinbelow with reference to the abovedescribed apparatus from FIGS. 1 to 4:

The laundry items are first of all ironed by the ironer 10 and then, as seen in the ironing direction 14, transported to the two, and through the two, identical folding machines 11 and 12, which are arranged one beside the other in a twinned configuration. The folding machines 11 and 12 fold the ironed laundry item simultaneously, to be precise at least once in the transverse direction and, thereafter, preferably also at least once in the longitudinal direction. The laundry items here pass through the transverse-folding stations 38, 39, 40 in the ironing direction 14, said transverse-folding stations being located one beside the other like the folding machines 11 and 12. In the regions of the transverse-folding stations 38, 39, 40, the direction in which the laundry items are transported through the adjacent folding machines 11, 12 therefore runs in the ironing direction 14 or in extension of the same.

In the case of large laundry items which take up more than half the operating width 28 of the ironer 10 or, for transversely directed ironing, extend beyond half the operating width 28 of the ironer 10, in which case the ironing takes place in one lane, the folding operation likewise takes place, following the ironing operation, in one lane using the two adjacent folding machines 11 and 12 simultaneously. The adjacent folding machines 11 and 12 here form a twin lane which extends, overall, over an operating width 26, which corresponds to the operating width 28 of the ironer 10 or is somewhat smaller or greater than this. The folding belts 30 of the belt conveyors 29 of the folding machines 11 and 12 here supplement one another such that adjacent folding belts 30, which in the same way are driven at equal speed and are located in at least one common plane, participate together in the folding operation, in particular in the at least one initial transverse-folding operation of the laundry item, exiting the ironer 10. The two adjacent folding machines 11 and 12 simultaneously fold the respective laundry item, which extends over folding belts 30 of the two folding machines 11 and 12, said two identical folding machines 11 and 12 arranged in tandem one beside the other being driven synchronously in the process.

If relatively small laundry items are ironed over two lanes using ironers 10 having a large operating width 28 of from 3 m to 7 m, in particular 4 m to 6 m, preferably 5 m plus/minus 10%, it is also possible for the ironed laundry items to be folded over two lanes, by the laundry items in the one lane of the ironer 10 being folded by the one folding machine 11 and the laundry items in the adjacent lane of the ironer 10 being folded by the other, adjacent folding machine 12. Since the folding machine is formed from two independent folding machines 11 and 12 arranged in tandem, or in a twinned configuration, one beside the other, it is possible, in two-lane operation, for the folding operations of the laundry items in the individual lanes, that is to say of the folding machine 11, on the one hand, and of the folding machine 12, on the other hand, to take place independently of one another, and therefore, in contrast to larger laundry items which do not allow a folding operation over two lanes, the folding of relatively small laundry items in two-lane operation need not necessarily take place concurrently and/or synchronously. It is also possible for the folding machines 11 and 12 to be driven at different speeds in two-lane operation for the folding of relatively small laundry items, this resulting in the folding speeds being different. It is likewise possible, in two-lane operation of the folding machines 11 and 12, for the laundry items to be folded in different folding arrangements by the folding machines 11 and 12, for example for the one folding machine 11 to perform more transverse-folding operations than the other folding machine 12. This is advantageous, in particular, when the laundry items which are ironed over two lanes are of different sizes.

Two adjacent folding machines 11 and 12 are provided in that exemplary embodiment of an apparatus which has been described above. However, the invention is not restricted to this. It is also possible for more than two folding machines, for example three folding machines, to be arranged one beside the other.

LIST OF REFERENCE SIGNS

10 Ironer
11 Folding machine
12 Folding machine
13 Supply conveyor
14 Ironing direction
15 Ironer body
16 Ironer belt
17 Entry region
18 Deflecting drum
19 Deflecting drum
20 Exit region
21 Deflecting drum
22 Deflecting drum
23 Deflecting drum
24 Deflecting drum
25 Removal conveyor
26 Operating width
27 Longitudinal center axis
28 Operating width
29 Belt conveyor
30 Folding belt
31 Folding gap
32 Deflecting drum
33 Bearing frame
34 Outer side
35 Inner side
36 Bearing frame
37 Spindle
38 Transverse-folding station
39 Transverse-folding station
40 Transverse-folding station
41 Longitudinal-folding station

What is claimed is:

1. An apparatus for ironing and folding laundry items using at least one ironer (10), having an entry region (17) and an exit region (20), which follows the entry region (17) in the ironing direction (14), and also at least one folding machine (11, 12), which follows the exit region (20) of the at least one ironer (10) in the ironing direction (14), wherein the at least one ironer (10) is followed by adjacent folding machines (11, 12), wherein mutually facing sides (35) of deflecting and driving drums of folding belts (30) of the two folding machines (11, 12) are mounted by way of bearing means which are arranged together between adjacent folding machines (11, 12).

2. The apparatus as claimed in claim 1, wherein the adjacent folding machines (11, 12) are of identical design.

3. The apparatus as claimed in claim 1, wherein the adjacent folding machines (11, 12) have identical operating widths (26).

4. The apparatus as claimed in claim 3, wherein the sum of the operating widths (26) of all the adjacent folding machines (11, 12) corresponds to the operating width (28) of the ironer (10).

5. The apparatus as claimed in claim 1, wherein at least those adjacent strands of the folding belts (30) of the adjacent folding machines (11, 12) which come into contact with laundry items which are to be folded transversely are located in a common plane.

6. An apparatus for ironing and folding laundry items using at least one ironer (10), having an entry region (17) and an exit region (20), which follows the entry region (17) in the ironing direction (14), and also at least one folding machine (11, 12), which follows the exit region (20) of the at least one ironer (10) in the ironing direction (14), wherein the at least one ironer (10) is followed by adjacent folding machines (11, 12), wherein outer sides (34) of the adjacent folding machines (11, 12) are assigned drives for folding belts (30).

7. The apparatus as claimed in claim 6, wherein mutually facing sides (35) of deflecting and driving drums of folding belts (30) of the two folding machines (11, 12) are mounted by way of bearing means which are arranged together between adjacent folding machines (11, 12).

8. The apparatus as claimed in claim 6, wherein the adjacent folding machines (11, 12) are of identical design.

9. The apparatus as claimed in claim 6, wherein the adjacent folding machines (11, 12) have identical operating widths (26).

10. The apparatus as claimed in claim 9, wherein the sum of the operating widths (26) of all the adjacent folding machines (11, 12) corresponds to the operating width (28) of the ironer (10).

11. The apparatus as claimed in claim 6, wherein at least those adjacent strands of the folding belts (30) of the adjacent folding machines (11, 12) which come into contact with laundry items which are to be folded transversely are located in a common plane.

12. An apparatus for ironing and folding laundry items using at least one ironer (10), having an entry region (17) and an exit region (20), which follows the entry region (17) in the ironing direction (14), and also at least one folding machine (11, 12), which follows the exit region (20) of the at least one ironer (10) in the ironing direction (14), wherein the at least one ironer (10) is followed by adjacent folding machines (11, 12), wherein each of the adjacent folding machines (11, 12) has a dedicated drive, wherein drives are assigned to outer sides (34) of the adjacent folding machines (11, 12).

13. The apparatus as claimed in claim 12, wherein the drives of the folding machines (11, 12) can be operated synchronously in the same way.

14. The apparatus as claimed in claim 12, wherein the drives of the folding machines (11, 12) can be operated optionally either synchronously in the same way or independently of one another.

15. The apparatus as claimed in claim 12, wherein mutually facing sides (35) of deflecting and driving drums of folding belts (30) of the two folding machines (11, 12) are mounted by way of bearing means which are arranged together between adjacent folding machines (11, 12).

16. The apparatus as claimed in claim 12, wherein the adjacent folding machines (11, 12) are of identical design.

17. The apparatus as claimed in claim 12, wherein the adjacent folding machines (11, 12) have identical operating widths (26).

18. The apparatus as claimed in claim 17, wherein the sum of the operating widths (26) of all the adjacent folding machines (11, 12) corresponds to the operating width (28) of the ironer (10).

19. The apparatus as claimed in claim 12, wherein at least those adjacent strands of the folding belts (30) of the adjacent folding machines (11, 12) which come into contact with laundry items which are to be folded transversely are located in a common plane.

* * * * *